United States Patent [19]

Barrett et al.

[11] 4,229,475

[45] Oct. 21, 1980

[54] PERMEABLE DRYER CYCLE FABRIC SOFTENER SHEET

[75] Inventors: John H. Barrett, La Mirada; Brian P. Flynn, Long Beach, both of Calif.

[73] Assignee: Purex Corporation, Lakewood, Calif.

[21] Appl. No.: 962,698

[22] Filed: Nov. 20, 1978

Related U.S. Application Data

[63] Continuation of Ser. No. 840,102, Oct. 6, 1977, abandoned.

[51] Int. Cl.[2] ..... B32B 3/10

[52] U.S. Cl. ..... 428/196; 427/242; 427/286; 428/195

[58] Field of Search ..... 427/242, 286; 34/9, 34/160; 428/195

[56] References Cited

U.S. PATENT DOCUMENTS

| | | | |
|---|---|---|---|
| 3,155,540 | 11/1964 | Loeffler et al. | 427/286 X |
| 3,895,128 | 7/1975 | Gaiser | 427/242 X |
| 3,956,556 | 5/1976 | McQueary | 428/131 |

*Primary Examiner*—Evan K. Lawrence

*Attorney, Agent, or Firm*—William W. Haefliger

[57] ABSTRACT

A fabric conditioner composition is distributed on an air permeable sheet in such manner that the conditioner occludes interior interstitial spaces in certain region of the sheet to block airflow therethrough, and other regions of the sheet have interstitially open spaces, there being additional interstitial spaces in those other regions which are relatively smaller and which contain remanent conditioner.

6 Claims, 9 Drawing Figures

FIG. 4.
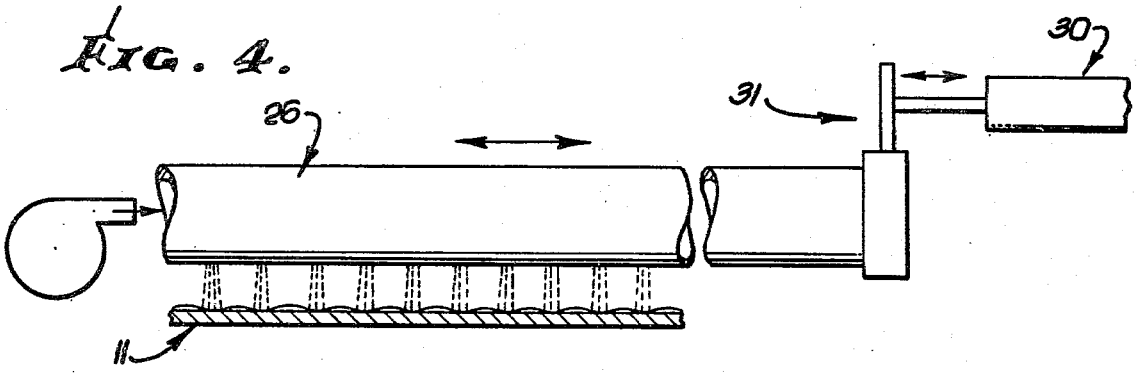
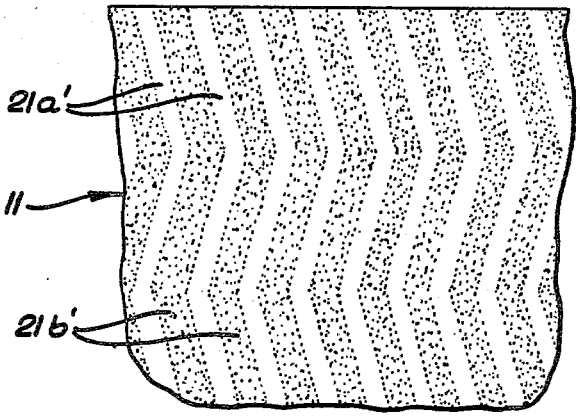
FIG. 5.
FIG. 6.
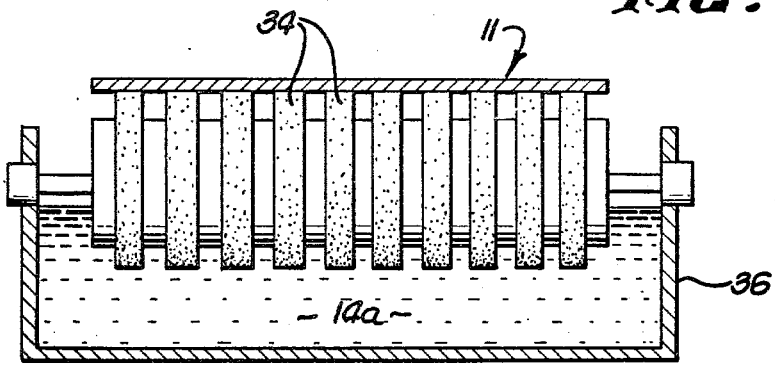
FIG. 7.
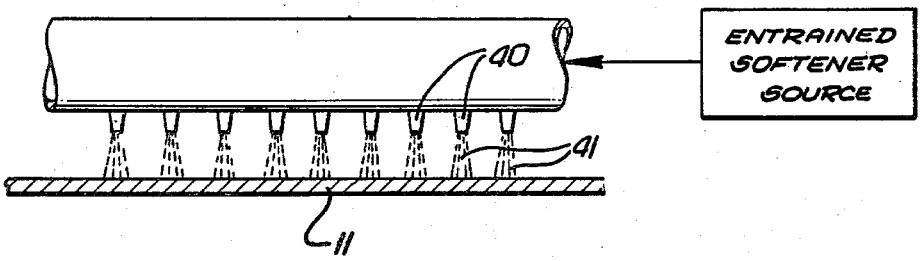

PERMEABLE DRYER CYCLE FABRIC SOFTENER SHEET

BACKGROUND OF THE INVENTION

This is a continuation, of application Ser. No. 840,102, filed Oct. 6, 1977, now abandoned.

This invention relates generally to the production of fabric conditioners, and more particularly concerns the application of such conditioners to air permeable sheets.

In the past, fabric conditioning sheets configured to tumble in a home laundry or commercial dryer oftentimes undesirably restricted air flow through the dryer, inhibiting drying and extending the drying cycle with consequent energy wastage. This came about because the sheets could partially or totally cover the dryer exhaust outlet port as during tumbling to cause the conditioning agent to leave the sheet and deposit on fabrics. The problem became exacerbated with the use of larger size sheets, for example 9 by 11 inch size. Attempts to solve the problems included slitting or perforating the sheets; however, certain problems remained, because slit sheets still tend to restrict air flow; and perforated sheets could carry less conditioning composition than unperforated sheets, and they also undesirably restricted air flow at the rather small size orifices formed by the perforations.

SUMMARY OF THE INVENTION

It is a major object of the invention to provide a product for obviating the above as well as other problems associated with use in laundry dryers of carrier sheets for fabric conditioning agents or compositions. Basically, the invention concerns an air permeable carrier sheet which is formed by applying a conditioning composition to a continuous and interstitially impregnatable, air permeable sheet with formation of localized concentrations of the composition so that the sheet has greater air permeability at sheet zones between the concentrations that at the concentrations. For example, after application of a fabric softener composition to an air permeable sheet, air jets may be projected against the sheet to displace the softener from the paths of the jets. Strip-like courses or concentrations of the softener are thereby produced if the sheet is continuously moved lengthwise relative to the air jets, and corresponding air-permeable strip-like zones of lesser or no concentration of softener are produced between the higher concentrations of softener. As a result, the sheet remains highly air-permeable even though it may carry an amount of softener composition or agent about the same as that normally applied generally uniformly over the surface of a perforated or unperforated sheet. See for example the disclosure in U.S. Pat. No. 3,895,128 to Gaiser, where 1.0 to 10.0 grams of a softening agent are applied to a paper sheet about 105 inches in area, for use in a household dryer.

An additional object is the provision of a product incorporating novel differential concentrations of the conditioning agent such as zig-zag or sinuous stripes.

These and other objects and advantages of the invention, as well as the details of illustrative embodiments, will be more fully understood from the following description and drawings, in which:

BRIEF DESCRIPTION OF THE DRAWING

FIG. 4 is a view like FIG. 2, but showing apparatus to produce zig-zag fabric softener concentrations on the carrier sheets;

FIG. 5 is a plan view of a carrier sheet coated with zig-zag fabric softener concentrations;

FIG. 6 is a frontal elevation showing modified apparatus to produce linear concentrations of fabric softener on a carrier sheet;

FIG. 7 is a frontal elevation showing other apparatus to produce linear concentrations.

DETAILED DESCRIPTION

Figure 1:
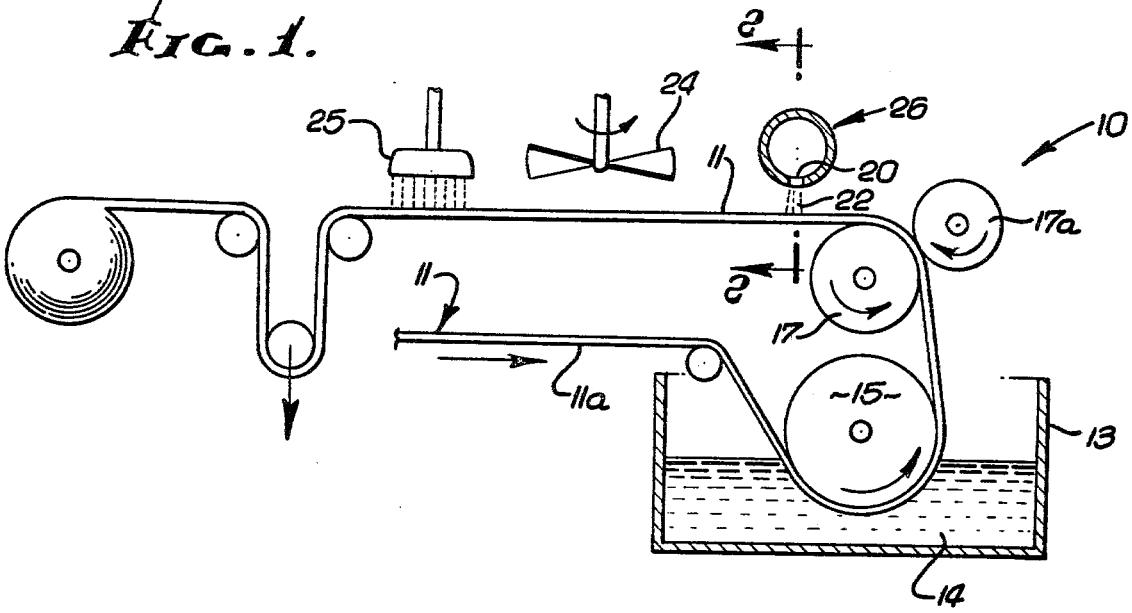
FIG. 1 is a side elevation view of apparatus usable to carry out the invention.
Figure 2:
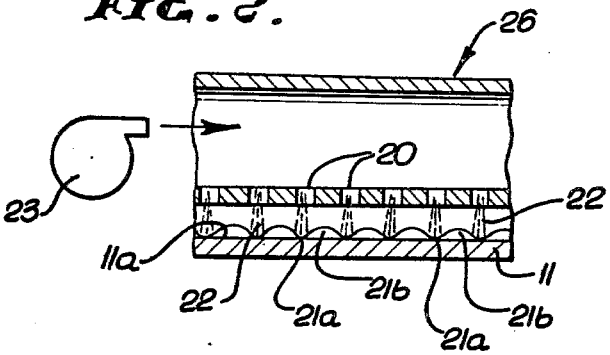
FIG. 2 is an enlarged section, in elevation, on lines 2—2 of FIG. 1.

Referring to FIGS. 1 and 2, apparatus is shown at 10 for producing a fabric conditioner, which employs an air permeable sheet 11. In general the apparatus includes means for effecting differential distribution of fabric conditioner onto the sheet as the sheet travels relatively past the apparatus, one example of such conditioner being fabric softener. Such means may include structure to first substantially uniformly coat at least one of the sheet surfaces 11*a*, or to impregnate the sheet, with the composition as the sheet travels lengthwise. For example, a receptacle 13 may contain liquid form coating composition 14 which transfers onto the sheet as it passes under roller 15. The latter is rotated in response to lengthwise travel of the sheet 11. As the sheet emerges from the bath 14, it passes through the nip between padding rolls 17 and 17*a*. The sheet may be trained about roller 17 so as to travel reversely with coated surface 11*a* upwardly presented as the sheet leaves roll 17 and travels to the left.

Figure 2A:
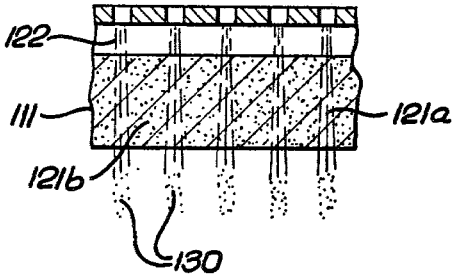
FIG. 2*a* is an enlarged section showing fabric differentially impregnated in accordance with the invention.

The means to effect differential distributions of fabric conditioner, such as softening composition onto the sheet also typically includes distributors facing the sheet for forming predetermined localized concentrations of the composition on the sheet, leaving it with greater permeability between the concentrations than at or directly under the concentrations. As shown in FIG. 2, such distributors comprise gas or air jet orifices 20 spaced apart transversely of the sheet 11 to project gas jets toward the sheet for displacing the conditioner, in wet or damp state, from the jet paths 22. This is exemplified in FIG. 2 by thinning or elimination of the composition coating at loci 21*a* directly under the jets, so as to leave the sheet relatively air permeable at such loci 21*a* and thickening of the coating at loci 21*b* laterally of said paths. FIG. 2*a* shows an air permeable sheet 111 characterized as having a network of fibers forming interstitial spaces therebetween. The conditioner impregnates the sheet to loosely coat the fibers at regions 121*b*; and the gas jets 122 blow through the sheet with sufficient force to remove the conditioner composition in divided particle form at 130, at opened pore regions 121*a*. Region 121*a* and 121*b* correspond to regions 21*a* and 21*b*.

Figure 3:
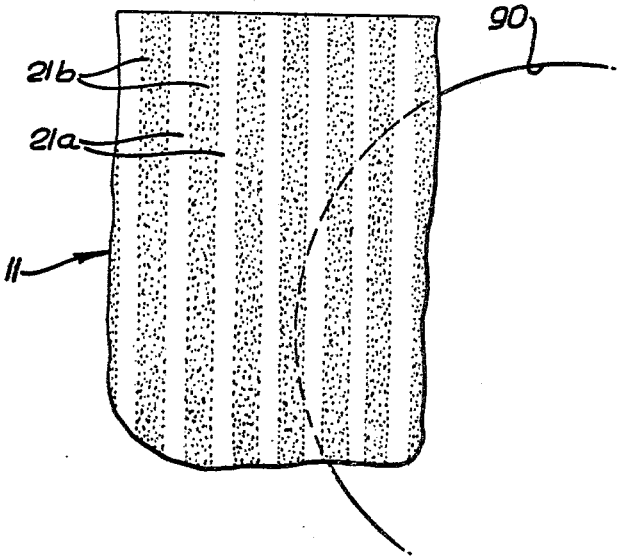
FIG. 3 is a plan view of a fragment of carrier sheet coated with fabric softener, in accordance with the invention.

The resultant sheet appears as in FIG. 3, with linearly extending loci 21*a* and 21*b*. It is found that the loci 21*a* of lesser or no coating or impregnation allow sufficient air to pass through the air-permeable sheet, should it for example be brought into partial or total covering relation with the hot damp air exhaust vent 90 in the dryer, so as not to undesirably restrict drying.

The air orifices 20 may be provided by perforating the wall of a pipe 26, say of ½ inch diameter, to width air is supplied under pressure by a blower 23. The orifices are preferably about 1/16 inch in diameter, and their centers are spaced about 1/6 inch apart. The air pressure supplied to the pipe is about 10 to 100 psi, i.e. to produce desired air permeability without rupturing the sheet material.

In a typical example, the sheet consisted of non-woven rayon substrate passed through a bath 14 of molten cationic fabric softener-isopropanol mixture and then through the nip between padder rolls 17 and 17*a*. For example, the bath consisted of 75% by weight of dimethyl di-tallow quaternary ammonium methyl sulfate, and 25% by weight of isopropanol solvent. Other additives such as perfume may be employed. After treatment by the jets 22, the sheet passed hot air fans 24 and infra red heat lamps 25.

The impregnated, dried product was cut into 9 by 11 inch sheets and tested for air permeability by positioning the sheet over the exhaust duct outlet from a Kenmore Model 96690100 household clothes dryer fitted with a Velometer at its exhaust duct to measure air velocity in feet/minute.

A sheet which was not treated by the jets 22 in accordance with the invention caused a 42% reduction in air flow velocity at the exhaust outlet. A sheet treated in accordance with the invention caused only 15% to 18% reduction in air flow velocity, where the jet orifice diameters were 1/16 inch and the orifices were spaced apart about 1/6 inch. It was further found that a sheet treated with air jets having 1/16 inch diameter orifices spaced apart ¼ inch produce a 31% reduction in dryer air outlet velocity. Using 1/16 inch air jet orifices spaced 1/6 inch apart, the lightly impregnated or coated loci 21*a* are about 1/12 inch wide.

The air permeable substrate or sheet may consist for example of non-woven or woven rayon or polyester, viscose, nylon, polyacrylonitrile, polyolefin, cellulose such as wet strength paper, or polyurethane. The sheet porosity is such that before treatment it has a fiber concentration allowing at least about 90% air passage therethrough, in a dryer. Microscopic examination of the finished product shows that the heavily impregnated areas have interstitial substrate spaces completely occluded with fabric conditioning agent, or softener, and the lightly impregnated areas 21*a* have larger interstitial substrate spaces completely free of the agent, although it may coat and fill smaller interstitial spaces. Thus, the other areas 21*a* in FIG. 3 are characterized by relatively larger spaces from which the conditioner has been removed by fluid streams, and there are additional interstitial spaces in such other areas or regions which are relatively smaller and which contain remanent conditioner. The conditioning agent may consist of any of the agents described, for example in U.S. Pat. No. 3,895,128 to Gaiser, and in U.S. Pat. No. 3,686,025 to Morton. Other agents may be employed, such as those to produce anti-static, anti-mildew, germicidal, moth proofing anti-wrinkling, and perfuming functions.

FIG. 4 shows the provisions of additional means effecting relatively transverse back and forth movement of the duct 26 and orifices 20. One such means includes an actuator 30 coupled at 31 to the duct 22. The resultant striping on the sheet 11 appears in FIG. 5, with alternate zig-zag or simuous occluded zones 21*b*′ and zig-zag or sinuous air permeable zones 21*a*′.

In FIG. 6 the conditioning agent applicators comprise transversely spaced parallel rollers 34 of stripe width. The rollers dip into the bath 14*a* of the molten agent, are coated, and transfer their coatings to the sheet 11. A receptacle for the bath appears at 36.

In FIG. 7 the applicators comprise jet orifices 40 spaced apart to project toward the sheet 11. Carrier gas jets 41 entrain the conditioning agent which is deposited in the moving sheet in stripe form. Alternatively, liquid conditioner may be applied in the manner of FIG. 7, without the use of carrier gas. The sheets 11 move normal to the planes of FIGS. 6 and 7.

Figure 8:
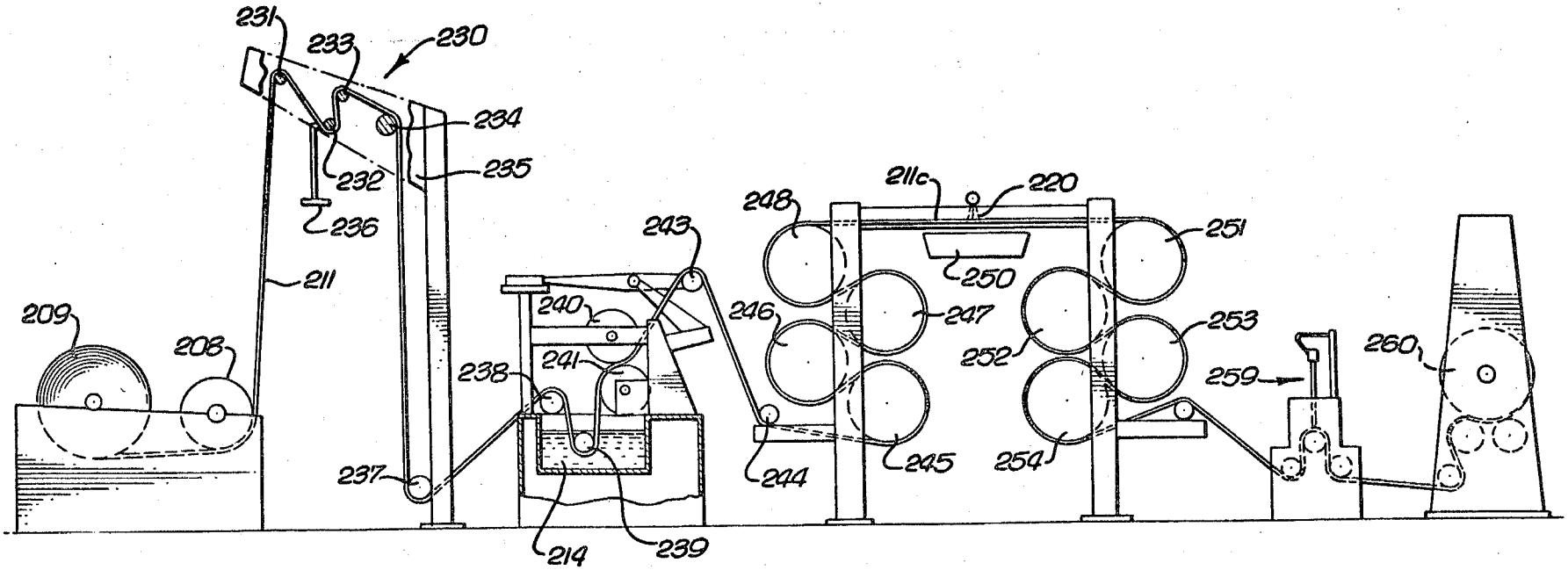
FIG. 8 is a side elevation showing other features of apparatus to produce the product.

In FIG. 8, the sheet strip 211 (corresponding to sheet 11 in FIGS. 1–3) unwinds off a supply roll 209, turns about roller 208, and passes through tensioner means indicated at 230. The latter includes rollers 231, 233 and 234 supported by frame 235, as indicated. Roller 232 is controlled by handle 236 to control tension of the sheet strip.

After turning about lower roller 237, and roller 238, the sheet strip enters the conditioning agent bath 214 corresponding to bath 14 in FIG. 1. The sheet strip passes about roller 239 and emerges from the bath coated on both sdes, or impregnated. It then passes through the nip between padding rollers 240 and 241, becoming further interstitially impregnated with the conditioning agent (for example fabric softener). Also, the rollers 240 and 241 remove excess agent from the sheet surfaces.

The sheet is then subjected to heating to temperatures between about 150° F. and 300° F. to drive off the solvent in the conditioner. For example, and strip is turned by rollers 243 and 244 to pass back and forth between and over heating drums 245–248. The conditioning agent is then in divided state, coating the fibers of the sheet. As the sheet strip passes horizontally at 211*c*, it is subjected to gas jet treatment at 220, in the same manner as described in FIG. 1 and FIG. 2*a*. Such treatment blows the conditioning agent out of certain interstitial zone of the sheet corresponding to spaced zones 121*a* in FIG. 2*a*, the removed agent being collected in pan 250.

Thereafter, the sheet strip passes back and forth between and over cooling drums 251–254, where it is cooled to ambient temperature effecting setting or solidifying of the conditioning agent bands or stripes left in the sheet. This assures that such bands will not subsequently be pushed or displaced into the adjacent and alternating air permeable bands or stripes, as described, upon subsequent mechanical treatment such as during slitting at 259 and winding on roll 260. Such slitting cuts the sheet strip into desired widths for laundry use.

We claim:

1. A fabric conditioning means adapted for use in a clothes dryer to allow substantially unrestricted hot airflow to the dryer exhaust duct in all positions of said means in the dryer, said means comprising (a) a continuous and interstitially impregnatable air-permeable carrier sheet, (b) a fabric conditioner composition on the sheet, (c) said conditioner defining local substantially regularly distributed concentrations thereof impregnating and occluding interior interstitial spaces in certain regions of the sheet interior to block airflow therethrough, the sheet with said conditioner characterized as having greater air permeability at other sheet interior regions located adjacent to and between said concentrations than at said concentrations, said other regions of the sheet characterized by interstitially open spaces, (d) said interstitially open spaces in said other sheet regions characterized as relatively larger spaces from which said conditioner has been removed by fluid streams, there being additional interstitial spaces in said other regions which are relatively smaller and which contain remanent conditioner.

2. The conditioning means of claim 1 wherein said concentrations have predetermined generally linear formation.

3. The conditioning means of claim 1 wherein said composition occludes the sheet to greater extent at said concentrations than between said concentrations.

4. The conditioning means of claim 3 wherein said concentrations have generally linear, zig-zag or sinuous formation.

5. The conditioning means of claim 1 wherein said composition consists of a fabric softener.

6. A fabric conditioning means adapted for use in a clothes dryer to allow substantially unrestricted hot airflow to the dryer exhaust duct in all positions of said means in the dryer, said means comprising (a) a continuous and interstitially impregnatable air-permeable carrier sheet, (b) a fabric conditioner composition on the sheet, (c) said conditioner defining local substantially regularly distributed concentrations thereof impregnating and occluding interior interstitial spaces in certain regions of the sheet interior to block airflow therethrouh, the sheet with said conditioner characterized as having greater air permeability at other sheet interior regions located adjacent to and between said concentrations than at said concentrations, said other regions of the sheet characterized by interstitially open spaces, (d) the permeability of said sheet resulting in a maximum of 15% to 18% reduction of dryer vent airflow velocity therethrough as compared with unimpeded dryer vent airflow velocity, (e) said interstitially open spaces in said other sheet regions characterized as relatively larger spaces from which said conditioner has been removed by fluid streams, there being additional interstitial spaces in said other regions which are relatively smaller and which contain remanent conditioner.

* * * * *